US008810402B2

(12) United States Patent
Smith

(10) Patent No.: US 8,810,402 B2
(45) Date of Patent: Aug. 19, 2014

(54) ELECTRONIC ARTICLE SURVEILLANCE

(75) Inventor: John Stephen Smith, San Jose, CA (US)

(73) Assignee: Alien Technology Corporation, Morgan Hill, CA (US)

( * ) Notice: Subject to any disclaimer, the term of this patent is extended or adjusted under 35 U.S.C. 154(b) by 134 days.

(21) Appl. No.: 13/355,457

(22) Filed: Jan. 20, 2012

(65) Prior Publication Data

US 2013/0187778 A1 Jul. 25, 2013

(51) Int. Cl.
*G08B 13/14* (2006.01)

(52) U.S. Cl.
USPC ..... 340/572.1; 340/539.13; 340/825.54

(58) Field of Classification Search
USPC ..... 340/572.1–572.9, 568.1, 539.1, 539.11, 340/505, 571, 539.13, 573.1, 825.54, 340/825.56
See application file for complete search history.

(56) References Cited

U.S. PATENT DOCUMENTS 6,002,344 A * 12/1999 Bandy et al. ..... 340/10.2
6,249,227 B1 * 6/2001 Brady et al. ..... 340/572.1
6,392,544 B1 * 5/2002 Collins et al. ..... 340/572.7
6,774,782 B2 * 8/2004 Runyon et al. ..... 340/505
7,528,721 B2 * 5/2009 Levin et al. ..... 340/572.1
2013/0194097 A1 * 8/2013 Joseph ..... 340/572.1

OTHER PUBLICATIONS

"EPC™ Radio-Frequency Identity Protocols Class-1 Generation-2 UHF RFID Protocol for Communications at 860 MHz to 960 MHz, Version 1.1.0" EPCglobal, Inc. Dec. 17, 2005, 100 pages.

* cited by examiner

*Primary Examiner* — Daniel Previl
(74) *Attorney, Agent, or Firm* — Blakely, Sokoloff, Taylor & Zafman LLP

(57) ABSTRACT

Methods and apparatuses for activating an electronic tag with an identifier via an access to a storage area of the electronic tag without database or authentication operations are described. The storage area may be accessed as a scratch pad memory. The identifier can identify an inventory including a plurality of articles. One of the articles is attached with the electronic tag. The electronic tag is active if the identifier is stored in the storage area. When the electronic tag is located within a proximity of the electronic gate device, the electronic tag may be inspected wirelessly from the electronic gate device. An alarm may be activated or caused via the electronic gate device if the inspection indicates the electronic tag is active.

61 Claims, 7 Drawing Sheets

ELECTRONIC ARTICLE SURVEILLANCE

FIELD OF INVENTION

The present invention relates generally to electronic surveillance systems. More particularly, this invention relates to an electronic tag based surveillance system without requiring authentication and database querying operations.

BACKGROUND

Electronic tags, such as Electronic Article Surveillance (EAS) tags or radio frequency identification (RFID) tags, have been widely used in retail checkout or inventory control to prevent shoplifting and/or unauthorized removal of articles from retail stores. Typically, these tags are attached to articles to store information describing the attached articles to help in tracking the movement of the articles and in updating the inventory records. It is desirable to combine the inventory use with EAS, to avoid the requirement for an inventory RFID tag and a separate EAS device.

One surveillance scheme is based on the information stored inside a tag to identify an attached article at an exit gate. For example, a database can be maintained to represent an up-to-date inventory of the store and queried to tell whether the article has been sold. However, a very high speed database may be required for this scheme to be effective such that counter actions can be initiated within fractions of seconds before it is too late to guard against the removal of unsold articles. The database must also be kept real time to within a few seconds from possibly many point of sale terminals Alternatively, a status bit may be stored in a tag to indicate whether an article has been sold or not and updated accordingly at a checkout registry. However, the status bit can not distinguish a tag in the store's inventory from a foreign tag brought into the store, which has possibly not been properly disabled at the other store, thus triggering "false positive" alarms which cause difficulties in acting on the information.

Another method for EAS protection involves "killing" or deactivating information in the tag permanently at the point of sale. If irreversible changes are to be made to the tags, then there is a possibility that an attacker might maliciously destroy the usefulness of the tags. Furthermore, password protection may then be required to update the status bit, or to kill the tag, or to permanently mark the tag as sold. As a result, databases may still be required to provide an inventory database and a password database for a surveillance scheme based on the status bit or other permanent changes to the tag. Such databases providing passwords may undesirable because of the requirement to maintain the information from different suppliers of tagged items, and the difficulties associated with interacting with the tag at the point of sale, obtaining the password and using to access permissions at the tag, and then changing the tag's memory appropriately, all during the momentary illumination of the tag by the beam of the reader at the point of sale.

Therefore, existing electronic surveillance systems do not provide a practical solution without requiring fast speed databases and/or password authentications.

SUMMARY OF THE DESCRIPTION

In one embodiment, a method is provided for electronic article surveillance of items in a store using RFID tags. An RFID tag may include a multi-bit segment of memory as EAS (Electronic Article Surveillance) memory, which is both readable and writable without the use of a password. A retailer may write a specific number as an in-inventory number into the EAS memory of all tags attached to items in the retailer's store inventory. The specific number may be selected to be distinguishable from such numbers in other stores. At the point of sale, for example, when an item is purchased, the EAS memory may be changed to some other number different from the in-inventory number. At the exit gate, RFID readers may be set up to scan for the in-inventory number in the EAS memory. Any tags which still have the in-inventory number in the EAS memory at the exit gate may indicate potentially stolen items.

In another embodiment, an identifier number stored in an RFID tag may be read by an RFID reader for a description of an item attached to the tag. The identifier number may be provided along with an alarm indication if the attached item is detected to be a potentially stolen item via the RFID reader. If the tag is returned by a customer to a particular store, the EAS memory in the tag may be reprogrammed with the in-inventory number for the particular store and placed back in inventory. If items have their EAS memory maliciously or accidentally changed, these items can simply be re-written with the in-inventory number, thus limiting the possible damage to the tagged inventory. In order to steal an item, a tag reader would have to be used in the store to write to a tag via RF signals or emissions and those signals could be monitored to catch such activities.

In another embodiment, a section (or region) of scratch pad memory (or storage area) is maintained in an RFID tag or an electronic tag to store an identifier (e.g. a number, a string of characters, alphanumerical symbols or other symbols) representing a status or state of an article or item attached (or affixed) to the tag. For example, the state may indicate that the article still belongs to an inventory or has already been sold. The section of scratch pad memory may be permanently prohibited from password or authentication protection to allow free and unrestricted access (e.g. read/write/update) from another device at anytime. At the time of selling, the section of memory may be updated (or written) with a separate identifier (e.g. a different number) indicating that the item associated with the tag is no longer in the inventory. When the item is removed from the inventory, the section of non-lockable memory of the tag may be inspected (or read) to verify that the item has indeed been sold or to trigger an alarm otherwise.

An embodiment of the present invention includes a method and apparatus that activate an electronic tag with an identifier via an open access to a storage area of the electronic tag. The identifier can identify or represent an inventory including a plurality of articles. One of the articles is attached with the electronic tag. The electronic tag may be active if the identifier is stored in the storage area of the electronic tag. In one embodiment, the access to the storage area of the electronic tag is prohibited from password protection. An electronic gate device may be configured to allow retrieval of the identifier within the electronic gate device without performing database query operations. When the electronic tag is located within a proximity of the electronic gate device, the electronic tag may be inspected wirelessly from the electronic gate device without the need to perform database operations nor use password authentication operations via the open access to the storage area of the electronic tag and the retrieval of the identifier within the electronic gate device. An alarm may be activated or caused via the electronic gate device if the inspection indicates the electronic tag is active.

In an alternative embodiment, the method and apparatus may request an RFID tag to store an identifier from an RFID reader device without authentication. The identifier may be stored in a storage area of the RFID tag via an access to the storage area freely available without password protection. The RFID tag is in an active state if the identifier is stored in the storage area. An electronic gate device may be configured with the identifier to allow access to the identifier within the electronic gate device without requiring database query operations. When the RFID tag is located within a proximity of the electronic gate device, data stored in the RFID tag may be wirelessly retrieved by the electronic gate device via the access to the storage area of the RFID tag. Whether the RFID tag is in the active state may be determined via the identifier accessed within the electronic gate device without performing database operations. The RFID tag may be determined to be in an inactive state if the data retrieved does not include the identifier. An alarm may be triggered via the electronic gate device if the determination indicates the RFID tag is in the active state.

Other features of the present invention will be apparent from the accompanying drawings and from the detailed description that follows.

BRIEF DESCRIPTION OF THE DRAWINGS

The present invention is illustrated by way of examples and not limitation in the figures of the accompanying drawings, in which like references indicate similar elements and in which.

DETAILED DESCRIPTION

Figure 1:
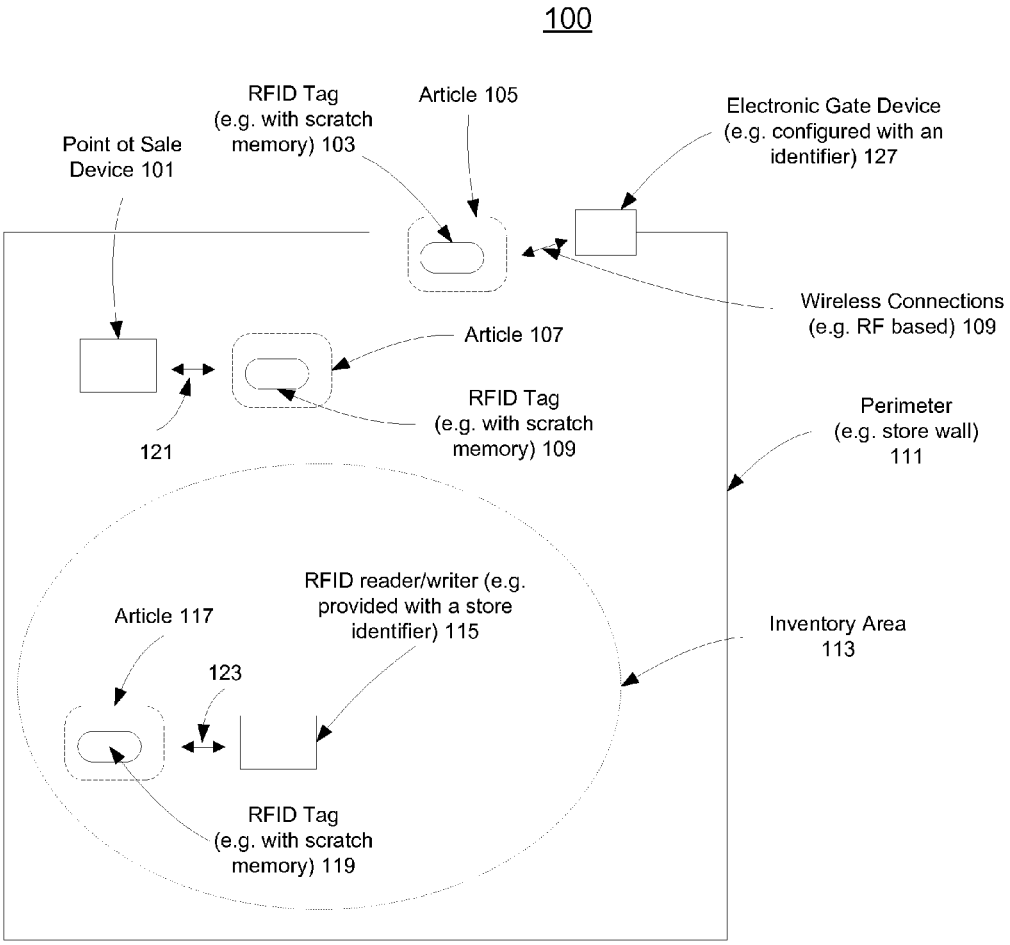
FIG. 1 is a system diagram illustrating one embodiment of article surveillance based on an identifier stored in RFID tags without password protection.

Methods and apparatuses for electronic surveillances without requiring database and authentication operations are described herein. In the following description, numerous specific details are set forth to provide thorough explanation of embodiments of the present invention. It will be apparent, however, to one skilled in the art, that embodiments of the present invention may be practiced without these specific details. In other instances, well-known components, structures, and techniques have not been shown in detail in order not to obscure the understanding of this description.

Reference in the specification to "one embodiment" or "an embodiment" means that a particular feature, structure, or characteristic described in connection with the embodiment can be included in at least one embodiment of the invention. The appearances of the phrase "in one embodiment" in various places in the specification do not necessarily all refer to the same embodiment.

The processes depicted in the figures that follow, are performed by processing logic that comprises hardware (e.g., circuitry, dedicated logic, etc.), software (such as is run on a general-purpose computer system or a dedicated machine), or a combination of both. Although the processes are described below in terms of some sequential operations, it should be appreciated that some of the operations described may be performed in different order. Moreover, some operations may be performed in parallel rather than sequentially.

The terms "host", "device", "interrogator" and "tag" are intended to refer generally to data processing systems rather than specifically to particular form factors.

According to one embodiment, an electronic surveillance system may be enabled without requiring password protection, authentication process, and database operations to be readily deployable in a practical and cost-effective manner. Whether an item attached to an electronic tag, such as RFID tag, is being removed without electronic authorization from an inventory (e.g. stolen) may be detected in real time without requiring potentially expensive operations such as fetching a password (or authentication data) via database queries and/or performing authorization steps via the fetched password.

In one embodiment, an electronic tag may be configured with a special section of a memory (e.g. a scratchpad memory) or storage area which allows unprotected free access, such as operations for reading, writing, updating, erasing, checking or other applicable data checking/changing instructions. A special code may be stored in the special section to indicate whether an article attached to the electronic tag is currently in inventory or not (e.g. sold). For example, each article or item in a store may be attached with a tag storing the same code identifying the store.

A device wirelessly (e.g. based on Radio Frequency) coupled to a tag may initiate data read/write operations to access a special section configured within the tag freely accessible without requiring password or other authentication. For example, at a point of exit of an inventory, a gate device may scan the tag wirelessly to inspect whether the special code or other applicable data or values are stored in the special section (e.g. predetermined addresses). When the special section in the tag is hacked or illegally changed (e.g. via an illegal RFID reader/writer device), it can be restored by storing the special code again without causing permanent damage to the tag.

Separate memory sections may be allocated within a tag to store or record, for example, information identifying specifics about the attached item. For example, the specifics about the attached item may include product categories, serial numbers or other applicable item identification data. As a result, tracking missing items and/or sold items to keep track of an inventory may be allowed in a surveillance system which is capable of retrieving or reading data including the specifics of the items from attached tags without using any databases or passwords.

In some embodiments, additional information, such as time stamps indicating time of sale, may be written to a tag via, for example, a point of sale device at checkout registry counter, to provide additional information for verifying if authorities should be notified when detecting an item attached to the tag is about to be moved out of the inventory.

In one embodiment, a large value (e.g. 64, 96, 128 or other applicable number of bits in length) may be picked as an identifier to represent an inventory (or a store) to significantly reduce the likelihood that two stores would share a common store identifier. Each article or item in the store may be attached with an RFID tag storing the identifier (e.g. at a particular memory address in the RFID tag) freely accessible independent of time, place, and accessing devices. The RFID tag may be updated by a point of sale device to erase the identifier or store a different value at the particular memory address without requiring the point of sale device to perform expensive database lookup and password matching operations.

At an exit gate of the store, the value of the particular memory address of the RFID tag may be inspected by a gate device to determine if the identifier is still stored at the particular memory address of the RFID tag. An alarm message may be issued momentarily (e.g. within seconds or fractions of a second) if the gate device detects the identifier at the particular memory address of the RFID tag to allow enough time to intercept the attached article. For example, the inspection may be conducted efficiently without requiring neither the gate device nor the RFID tag to perform database and/or authentication operations. The large value representing the identifier may reduce potential number of conflicts, thus false alarms, caused by conflicting identifiers assigned for different stores.

In certain embodiments, an RFID tag may comprise a re-writable memory to store a number for participating in an inventory of articles. For example, a first multi-bit number may be sent to multiple RFID tags attached to articles to establish the inventory from an RFID reader device (or devices) based on an EPC (Electronic Product Code) Gen (Generation) 2 select command from a reader device. The tags may store the first number received in the re-writable memory to become a part of the inventory. In one embodiment, a tag may update (e.g. set or unset) a flag, such as an SL (selected) flag, to indicate that the tag has participated in the inventory. For example, the select command may specify an action to unset the SL flags of the tag to join the inventory. Optionally, the tag may transfer (e.g. wirelessly) an EPC ID (Identifier) identifying the tag back to the reader device for processing the inventory (e.g. to store identities of the tags in the inventory).

At a point of sale of an article attached with a tag, a second number different from the first multi-bit number may be stored into a re-writable memory of the tag to indicate removal of the article from an inventory (e.g. completion of a sale). In one embodiment, at an EAS gate exiting an inventory area, the first number may be sent (e.g. by the EAS gate) to the tag to compare to a number stored in the re-writable memory of the tag. Identifying information may be obtained (or received) at the EAS gate from the tag to indicate whether the number has been changed from the first number based on the comparison. In one embodiment, identifying information may include status or identity data based on, for example, EPC™ Radio-Frequency Identity Protocols, Version 1.1.0, 2005.

In another embodiment, identifying information from a tag (e.g. RFID tag) may be received from a tag, e.g. at an EAS gate or an RFID reader device, only when a potential theft event occurs. For example, the tag may send out the identifying information if a comparison at the tag between a number stored in a re-writable memory of the tag and a separate number received at the tag (e.g. from the EAS gate or RFID reader device) the number has not been changed from the separate number. An anti-theft alert may be activated as a result of the identifying information obtained from the tag. For example, via a message from the EAS gate which has received the identifying information.

FIG. 1 is a system diagram illustrating one embodiment of article surveillance based on an identifier stored in RFID tags without password protection. In one embodiment, system 100 may include articles (or items) placed in an inventory area 113 within perimeter 111, for example, enclosing a store offering article 117 for sale. Articles 117, 107, 105 may be attached with electronic tags, such as RFID tags 119, 109, 103 respectively to allow automatic tracking of the articles in different statuses to prevent the articles from being stolen.

In one embodiment, system 100 may be configured with one identifier marking inventory within a store (e.g. inside perimeter 111). Each article in the store may be attached with an electronic tag storing the identifier in a freely accessible storage area within the electronic tag. For example, RFID tag 119 of article 117 may include a scratchpad memory to store the identifier. In one embodiment, an RFID reader/writer device (or electronic reader or writer device) 115 may provide the identifier via wireless connection 123 to instruct tag 119 to store (or write) the identifier in the scratchpad memory. Wireless connection 123 may be established in real time when reader/writer 115 is located within a proximity of article 117.

System 100 may include point of sale device 101 capable of updating statues of an electronic tag attached to an article to indicate the article has been paid for or sold. For example, point of sale device 101 may be located in a check-out register for checking out article 107 to deactivate an electronic tag. In one embodiment, point of sale device 101 may deactivate tag 109 attached to article 107 by erasing an inventory (or store) identifier from a scratchpad memory of tag 109 without using a password or other authentication mechanism. Alternatively, a number different from the identifier may be stored in place of the identifier in tag 109 to deactivate tag 109. Wireless instructions may be sent between point of sale device 101 and tag 109 via wireless connections 121 established on the fly (or on demand) when article 107 is being checked out.

In one embodiment, system 100 may include electronic gate device 127 located in the vicinity of an exit of store perimeter 111. As article 105 is being removed from the store, wireless connections 109 may be automatically established between tag 103 attached to article 105 and electronic gate device 127 to allow status inspection of tag 103 to determine whether article 105 is allowed to be removed from the store. Electronic gate device 127 may be configured to check tags for an identifier representing the store and retrieve data from tag 103 without performing expensive database query operations nor other lookup operations to enable efficient identification of legitimacy of article 105 passing by.

In some embodiments, data stored in a scratch pad section of a memory in tag 103 may be freely accessible by electronic gate device 127, for example, via wireless connections 109, without a need to present a password nor complete authentication (or authorization) operations. Electronic gate device 127 may detect or recognize a status (e.g. active or inactive) of tag 103 attached to article 105 in a short period of time to effectively block illegitimate removal of article 105.

In one embodiment, electronic gate device 127 may compare data retrieved from tag 103 with an identifier configured inside device 127. The comparison may indicate an active status for tag 103 if the data retrieved from tag 103 matches the identifier. Electronic gate device 127 may initiate an alarm message once the active status of tag 103 is detected for article 105. Alternatively, electronic gate device 127 may determine that tag 103 has been deactivated in an inactive status without activating an alarm if the data indicates the identifier is not stored in tag 103 of article 105.

In one embodiment, electronic gate device 127 may send data to a tag 103 to compare with an identifier configured inside device 127. The comparison may indicate an active status for tag 103 if the data at the tag 103 matches the identifier. Electronic gate device 127 may initiate an alarm message once the active status of tag 103 is detected for article 105. Alternatively, electronic gate device 127 may determine that tag 103 has been deactivated to an inactive status without activating an alarm if the data indicates the identifier is not stored in tag 103 of article 105.

Figure 2:
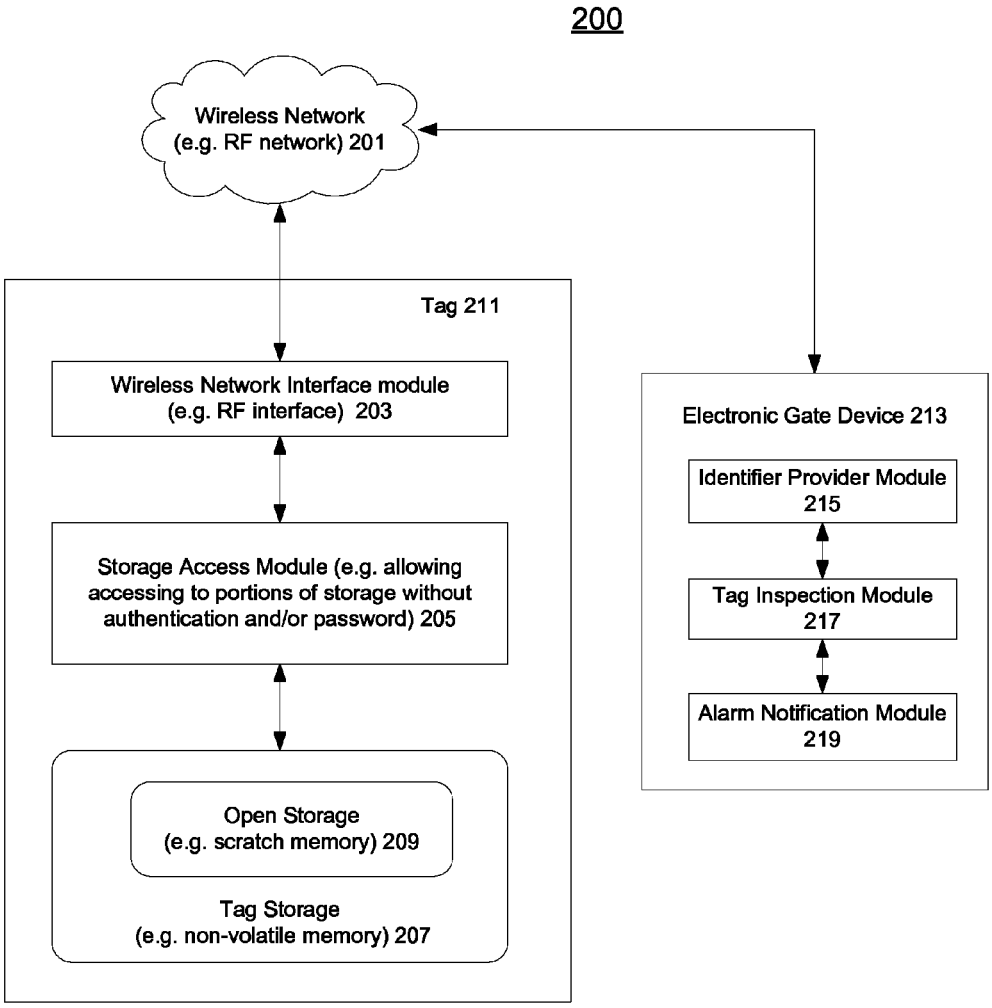
FIG. 2 is a block diagram illustrating one embodiment of system components for article surveillance without database operations.

FIG. 2 is a block diagram illustrating one embodiment of system components for article surveillance without database operations. System 200 may include tag 211 capable of establishing wireless connections (e.g. via dipole antennae, loop antennae and/or other applicable antennae) with electronic gate device 213 via wireless network 201. Tag 211 may be attached to an article, such as article 105 of FIG. 1. In one embodiment, tag 211 may include wireless network interface module 203 using, for example, radio frequency based network interfaces. Wireless network interface module 203 may broadcast data packets periodically to enable wireless network connections established with device 213 on the fly when tag 211 and device 213 are located close by within a proximity (e.g. several feet or less) between each other.

In one embodiment, tag 211 may include tag storage 207 for data storage in a non-volatile or persistent manner. Access to tag storage 207 may be based on operations performed via storage access modules 205. In one embodiment, tag 211 may include open storage 209 freely accessible from other devices, such as device 213, without protection or prohibited from being locked via a password or an authentication mechanism. Thus, any device, such as device 213, coupled with tag 211 may freely perform data read/write/update etc. operations on open storage 209 via storage access modules 205.

In some embodiments, storage access module 205 may be capable of performing locking operations on a lockable portion of tag storage 207, which is separate from open storage 209, to prevent access to the lockable portion of tag storage 207 without, for example, a matching password, successful authorizations, and/or completing other applicable authentication mechanisms. Storage access module 205 may ignore or reject requests for performing lock operations on open storage 209.

Electronic gate device 213, such as device 107 of FIG. 1, may include an identifier provider module 215 to make an identifier available for tag inspection module 217 without performing database query operations or time consuming lookup operations. An identifier may be a number or a string with a fixed number of bit length (e.g. 16 bits, 32 bits, 128 bits, or other applicable number of bits etc.) In one embodiment, device 213 may be configured to store the identifier locally. Alternatively, identifier provider module 215 may fetch the identifier directly from a separate device coupled to device 213 as if the identifier is stored locally without performing database query operations or other time consuming search operations. The tag identifier may be accessed in device 213 independent of specific tags coupled to device 213.

According to some embodiments, tag inspection module 217 may send requests via wireless network 201 to access data stored in tag 211. For example, tag inspection module 217 may request to read data stored in open storage 209 of tag 211 without sending authentication data, such as password. In response, tag 211 may return data read from open storage 209 back to device 213. Tag inspection module 217 may match an identifier via identifier provider module 215 with the data retrieved from tag 211 to determine, for example, if tag 211 has been deactivated. In one embodiment, if the data retrieved from tag 211 matches or includes the identifier, tag inspection module 217 may determine that tag 211 has not been deactivated (e.g. in an active state) and notify alarm notification module 219 to issue an alarm message or activate an alarm device. Thus, effectiveness of the alarm can be increased as the time required between establishing wireless network 201 and issuing an alarm for tag 211, if needed, is reduced without spending resources in performing database operations, password matching nor authentication actions.

Figure 3:
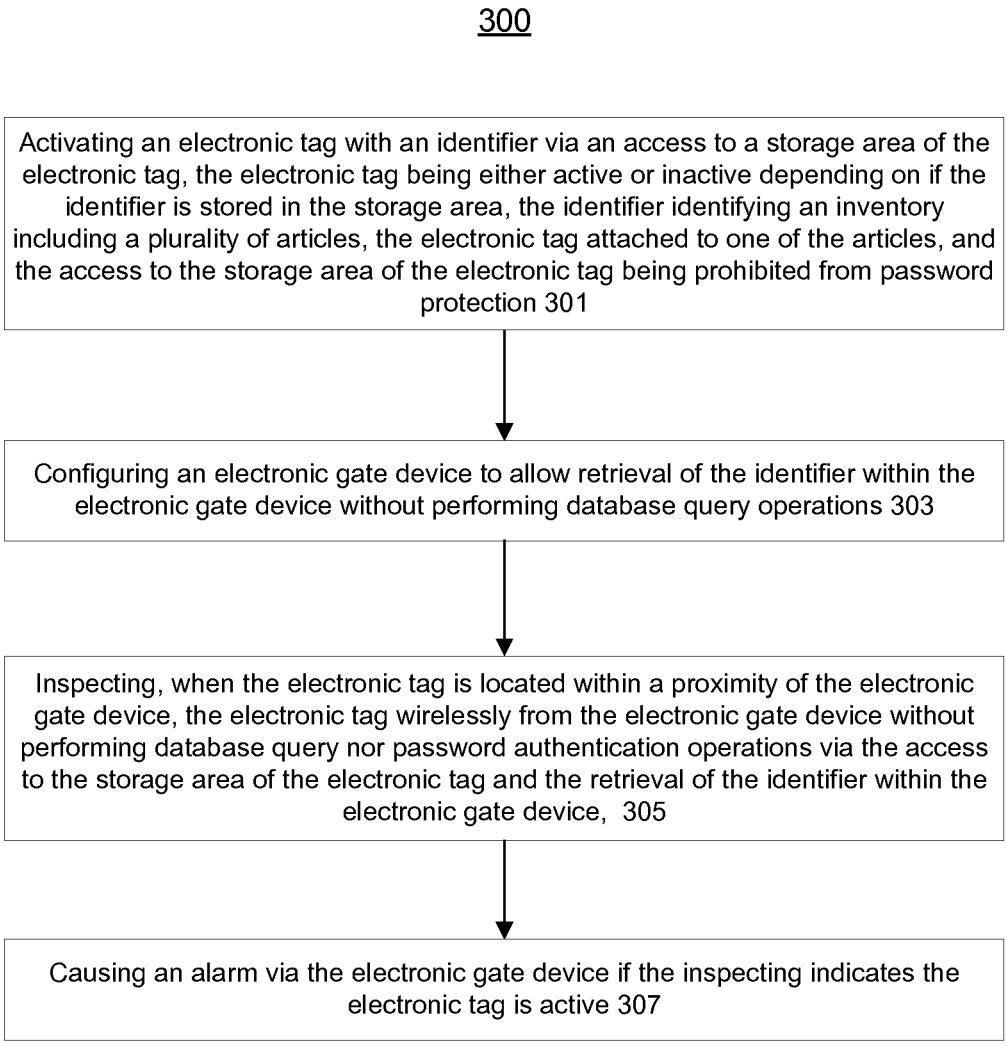
FIG. 3 is a flow diagram illustrating one embodiment of a process for electronic surveillance described herein.

FIG. 3 is a flow diagram illustrating one embodiment of a process for electronic surveillance described herein. For example, process 300 may be performed by some components of an electronic surveillance system, such as system 100 of FIG. 1. At block 301, the processing logic of process 300 may activate an electronic tag (e.g. an RFID tag) to store an identifier in a storage area of the electronic tag. Access to the storage area (e.g. for read/write/update/erase/reset or other applicable operations etc.) of the electronic tag may be openly available without or prohibiting protection from password or other authentication mechanisms.

In one embodiment, an electronic tag may be in either an active state or an inactive state. The electronic tag may be in the active state if a predetermined identifier is stored in a particular storage area allocated in the electronic tag. The particular storage area for each tag may be freely accessible and prohibited from password protection. The predetermined identifier may be applicable to each of the tags attached to articles, for example, in a store to represent or identify the store (or inventory).

At block 303, in one embodiment, the process of processing logic 300 may configure an electronic gate device, such as device 107 of FIG. 1, with an identifier to allow retrieval of the identifier within the electronic gate device without performing database query operations. For example, the identifier may be stored in the electronic gate device to make the identifier locally available without performing searching, lookup querying or other time/resource consuming operations in the electronic gate device.

At block 305, according to one embodiment, the processing logic of process 300 may inspect an electronic tag wirelessly from an electronic gate when the electronic tag is located within a proximity of the electronic gate, for example, as an article attached with the electronic tag may be about to exit a store area through an exit gate equipped with the electronic gate. Wireless connections between the electronic tag and the electronic gate may be automatically established dynamically (e.g. via receiving of broadcast data packets from the electronic tag) for the inspection.

In one embodiment, the processing logic of process 300 may send an electronic tag data accessing requests, such as read instructions, to retrieve data wirelessly from the electronic tag for an electronic gate. The accessing requests may be granted automatically in the electronic tag for data stored in a storage area configured to be freely accessible without password protection or authentication operations. The processing logic of process 300 may compare an identifier retrieved locally, without performing database query operations or password authentication operations with the data retrieved from the electronic tag to determine if the electronic tag active or inactive. If the data does not include or match the identifier, the electronic tag may have been deactivated or placed in an inactive state. Otherwise, the electronic tag may still be active indicating, for example, an article attached with the electronic tag should not be permitted from entering a proximity of the electronic gate. At block 307, the processing logic of process 300 may cause an alarm to activate via the electronic gate device if the electronic tag is found active via the inspection.

In one embodiment, the processing logic of process 300 may send an electronic tag data matching requests, such as select instructions, to compare data sent wirelessly from the electronic tag from an electronic gate. The processing logic of the tag may compare the sent data with the data retrieved from the electronic tag to determine if the electronic tag active or inactive. If the data does not include or match the identifier, the electronic tag may have been deactivated or placed in an inactive state. Otherwise, the electronic tag may still be active indicating, for example, an article attached with the electronic tag should not be permitted from entering a proximity of the electronic gate. At block 307, the processing logic of process 300 may cause an alarm to activate via the electronic gate device if the electronic tag is found active via the inspection.

Figure 4:
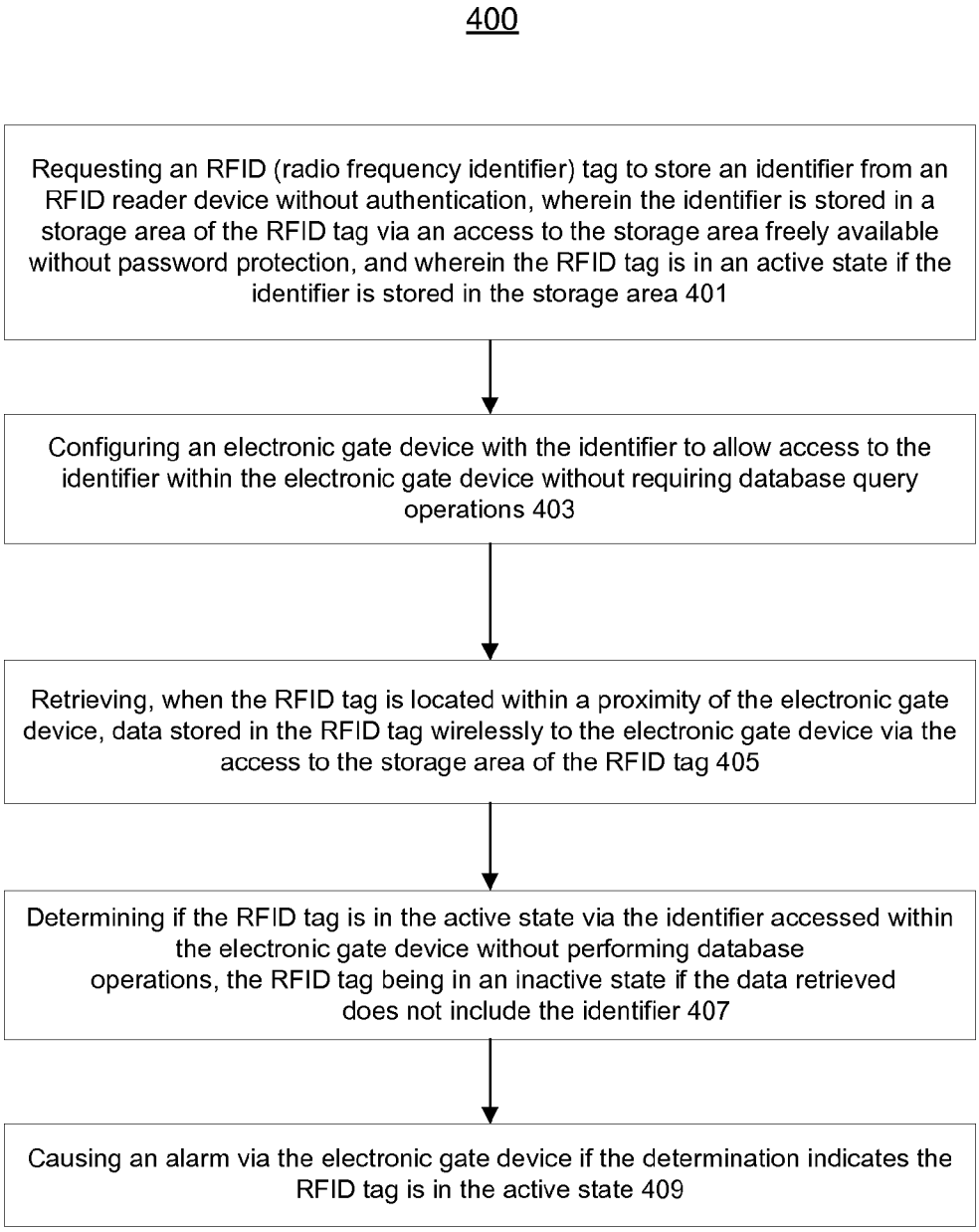
FIG. 4 is a flow diagram illustrating another embodiment of a process for electronic surveillance described herein.

FIG. 4 is a flow diagram illustrating another embodiment of a process for electronic surveillance described herein. For example, process 400 may be performed by some components of an electronic surveillance system, such as system 100 of FIG. 1. At block 401, the processing logic of process 400 may request an RFID tag (or other applicable electronic tag) to store an identifier from an RFID reader and/or writer device without authentication nor password. The identifier may be predetermined to represent a store or an inventory.

In one embodiment, an RFID tag may store an identifier representing an inventory in a storage area allocated within the tag to be freely available with an access prohibited from being locked or controlled via authentication mechanism, such as password matching. The RFID tag may be in an active state if the identifier is stored in the storage area to indicate that the RFID tag has been activated. The active RFID tag may indicate an item attached to the RFID tag is currently tracked as part of an inventory of a store.

AT block 403, the processing logic of process 400 may configure an electronic gate device with an identifier to allow access to the identifier within the electronic gate device without requiring database query operations. For example, the identifier may be stored at a predetermined or fixed location or address, such as memory location, network location, or other addressable destination. Optionally or alternatively, the electronic gate device may retrieve the identifier directly from broadcasting message data to allow the identifier to be readily available for the electronic gate device whenever needed.

At block 405, when the RFID tag is located within a proximity of the electronic gate device, the processing logic of process 400 may retrieve data stored in the RFID tag wirelessly to the electronic gate device via a access without password to a storage area in the RFID tag. Optionally or alternatively, the information retrieved from the tags may be specified by a in-inventory number, At block 407, the processing logic of process 400 may determine if the RFID tag is in an active state according to the identifier. In one embodiment, access to the identifier within the electronic gate device may be configured to be directly available without requiring expensive database operations. The RFID tag may be determined to be in an inactive state if the data retrieved does not correspond to the tag in-inventory number. If the RFID is determined to be still in an active state, at block 409, the processing logic of process 400 may cause or trigger an alarm via the electronic gate device.

Figure 5:
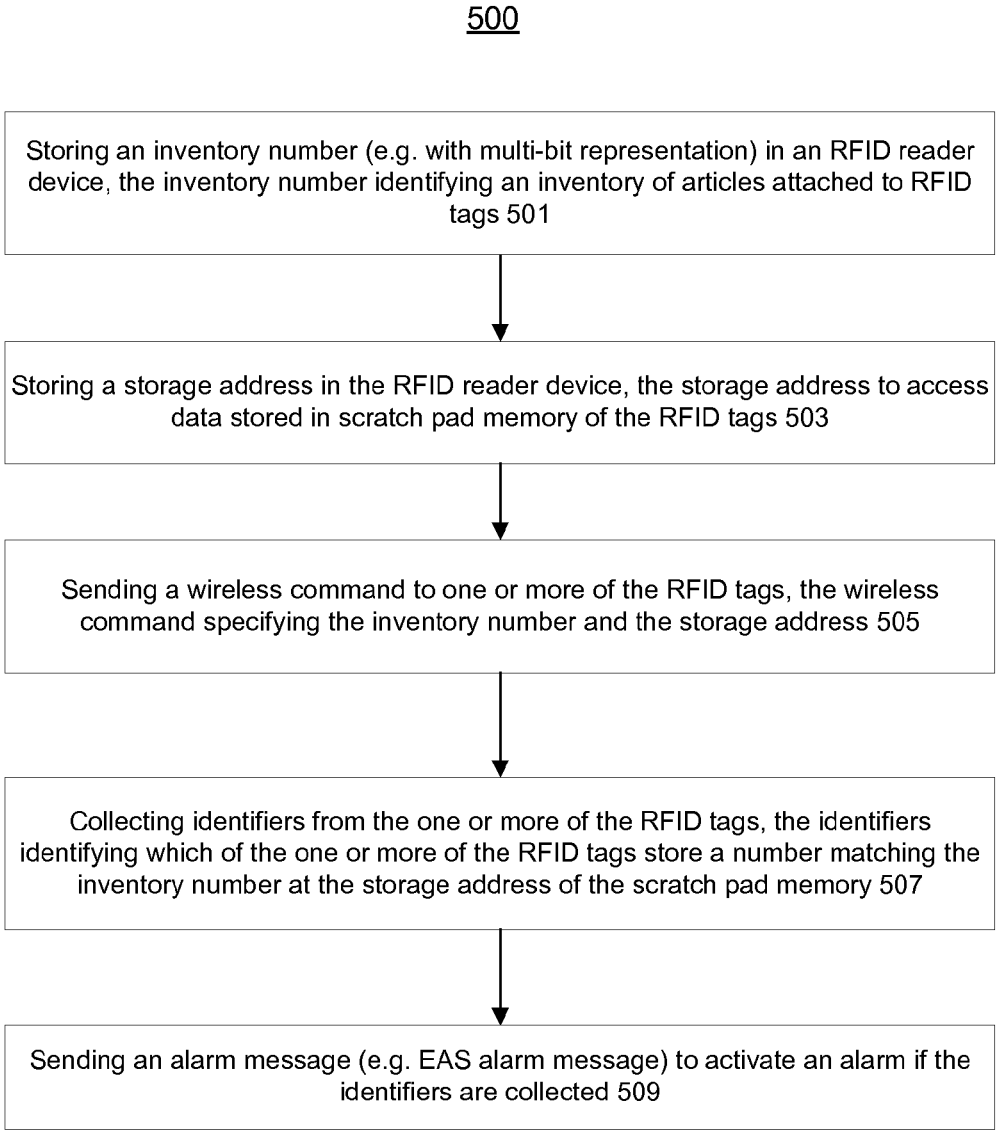
FIG. 5 is a flow diagram illustrating another embodiment of a process for electronic surveillance via a reader device described herein.

FIG. 5 is a flow diagram illustrating another embodiment of a process for electronic surveillance via a reader device described herein. For example, process 500 may be performed by some components of an electronic surveillance system, such as system 100 of FIG. 1. In one embodiment, at block 501, the processing logic of process 500 may store or configure an RFID reader device an inventory number, e.g. wirelessly received from a remote server or optically obtained from a bar code label.

In some embodiments, an inventory number may identify an inventory of articles attached to RFID tags. The inventory number may be a multi-bit number capable of representing a number of different inventories. At block 503, the processing logic of process 500 may store (or configure) a storage address in an RFID reader device for accessing data or number stored in scratch pad or open memories of the RFID tags.

At block 505, in one embodiment, the processing logic of process 500 may send a wireless command to RFID tags within proximity of an RFID reader (or writer) device. The wireless command can specify an inventory number and a storage address to access data or a number stored at the storage address of a scratch pad memory in the RFID tags. Subsequently, at block 507, the processing logic of process 500 may conduct selection operations and/or collect identifiers from the RFID tag to identify which of the RFID tags store a number matching the inventory number at the storage address of the scratch pad memory. For example, the processing logic of processing logic of process 500 may receive the identifiers, if there are any, within a predetermined period of time after sending the wireless command.

In one embodiment, an RFID tag may compare the inventory number received with a number stored at the storage address of a scratch pad (or open) memory of the RFID tag. If the comparison indicates a match, the RFID tag may send (e.g. broadcast) an identifier of the RFID tag back to an RFID reader. The RFID tag may not send a response if there is no match. The processing logic of process 500 may sending an alarm message (e.g. EAS alarm message) to activate an alarm if any identifier is collected from the RFID tags.

Figure 6:
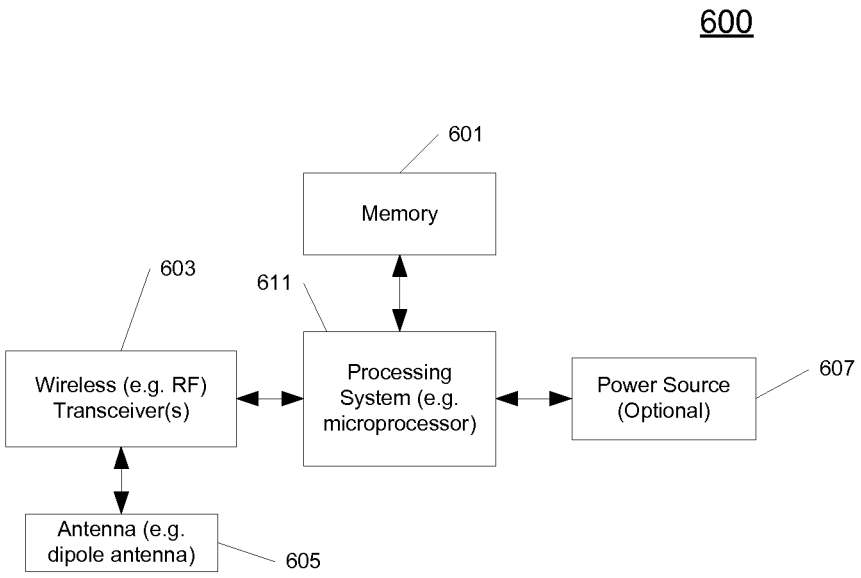
FIG. 6 illustrates one example of a typical identifier system which may be used in conjunction with an embodiment described herein.

FIG. 6 illustrates one example of a typical identifier system which may be used in conjunction with an embodiment described herein. For example, system 600 may be implemented as part of system as shown in FIG. 2. The data processing system 600 shown in FIG. 6 includes a processing system 611, which may be one or more microprocessors, or which may be a system on a chip integrated circuit, and the system also includes memory 601 for storing data and programs for execution by the processing system.

The system 600 also includes one or more wireless transceivers 603 to communicate with another data processing system. A wireless transceiver may be a RF transceiver for an active RFID network. An antenna system 605 may be coupled with the wireless transceiver 603. Additionally, system 600 may optionally include a power source 607. The power source may be a built-in battery or a replaceable battery. In one embodiment, power source 607 may be based on solar energy source or driven by an external energy source. It will be appreciated that additional components, not shown, may also be part of the system 600 in certain embodiments, and in certain embodiments fewer components than shown in FIG. 6 may also be used in a data processing system.

Figure 7:
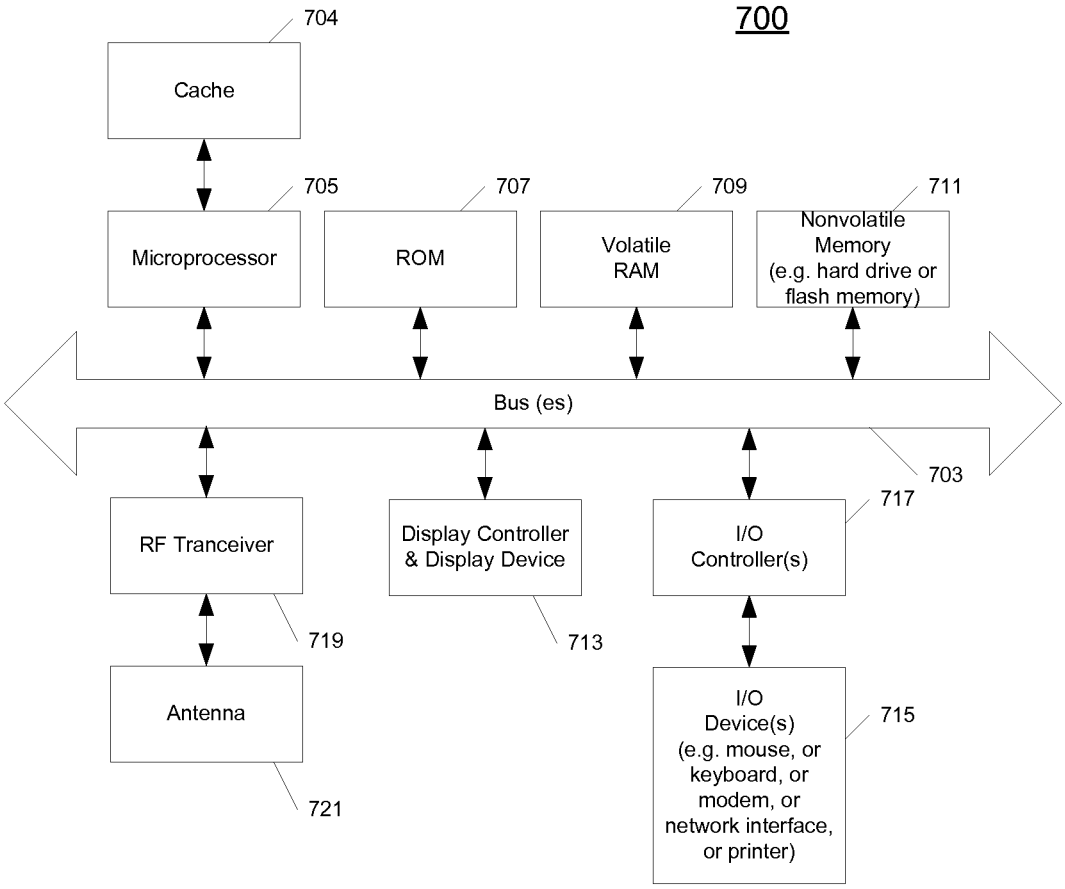
FIG. 7 illustrates an example of a data processing system that may be used with one embodiment of a wireless identifier device of the present invention.

FIG. 7 illustrates an example of a data processing system that may be used with one embodiment of a wireless identifier device of the present invention. For example, the system 700 may be implemented as a part of the systems shown in FIG. 1. Note that while FIG. 7 illustrates various components of a computer system, it is not intended to represent any particular architecture or manner of interconnecting the components as such details are not germane to the present invention. It will also be appreciated that network computers and other data processing systems which have fewer components or perhaps more components may also be used with the present invention.

As shown in FIG. 7, the system 700, which is a form of a data processing system, includes a bus 703 that is coupled to a microprocessor(s) 705, a ROM (Read Only Memory) 707, volatile RAM 709, and a non-volatile memory 711. The microprocessor 703 may retrieve the instructions from the memories 707, 709, 711 and execute the instructions to perform operations described above. The bus 703 interconnects these various components together and also interconnects these components 705, 707, 709, and 711 to a display controller and display device 713 and to peripheral devices such as input/output (I/O) devices 715 which may be mice, keyboards, modems, network interfaces, printers and other devices, which are well known in the art. Typically, the input/output devices 715 are coupled to the system through input/output controllers 717. The volatile RAM (Random Access Memory) 709 is typically implemented as dynamic RAM (DRAM) which requires power continually in order to refresh or maintain the data in the memory.

Additionally, a wireless transceiver 719 may be coupled with bus 703 to provide an interface to a wireless network. The wireless transceiver 719 may be a radio frequency (RF) transceiver (e.g., an RF transceiver for an RFID wireless network) or a Wi-Fi transceiver for IEEE 802 based wireless network. Transceiver 719 may be coupled with an antenna system 721.

The mass storage 711 is typically a magnetic hard drive or a magnetic optical drive or an optical drive or a DVD RAM or a flash memory or other types of memory systems which maintain data (e.g. large amounts of data) even after power is removed from the system. Typically, the mass storage 711 will also be a random access memory although this is not required. While FIG. 7 shows that the mass storage 711 is a local device coupled directly to the rest of the components in the data processing system, it will be appreciated that the present invention may utilize a non-volatile memory which is remote from the system, such as a network storage device which is coupled to the data processing system through a network interface such as a modem or Ethernet interface or wireless networking interface. The bus 703 may include one or more buses connected to each other through various bridges, controllers and/or adapters as is well known in the art.

Portions of what was described above may be implemented with logic circuitry such as a dedicated logic circuit or with a microcontroller or other form of processing core that executes program code instructions. Thus processes taught by the discussion above may be performed with program code such as machine-executable instructions that cause a machine that executes these instructions to perform certain functions. In this context, a "machine" may be a machine that converts intermediate form (or "abstract") instructions into processor specific instructions (e.g., an abstract execution environment such as a "virtual machine" (e.g., a Java Virtual Machine), an interpreter, a Common Language Runtime, a high-level language virtual machine, etc.), and/or, electronic circuitry disposed on a semiconductor chip (e.g., "logic circuitry" implemented with transistors) designed to execute instructions such as a general-purpose processor and/or a special-purpose processor. Processes taught by the discussion above may also be performed by (in the alternative to a machine or in combination with a machine) electronic circuitry designed to perform the processes (or a portion thereof) without the execution of program code.

An article of manufacture may be used to store program code. An article of manufacture that stores program code may be embodied as, but is not limited to, one or more memories (e.g., one or more flash memories, random access memories (static, dynamic or other)), optical disks, CD-ROMs, DVD ROMs, EPROMs, EEPROMs, magnetic or optical cards or other type of machine-readable media suitable for storing electronic instructions. Program code may also be downloaded from a remote computer (e.g., a server) to a requesting computer (e.g., a client) by way of data signals embodied in a propagation medium (e.g., via a communication link (e.g., a network connection)).

The preceding detailed descriptions are presented in terms of algorithms and symbolic representations of operations on data bits within a computer memory. These algorithmic descriptions and representations are the tools used by those skilled in the data processing arts to most effectively convey the substance of their work to others skilled in the art. An algorithm is here, and generally, conceived to be a self-consistent sequence of operations leading to a desired result. The operations are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be kept in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to an apparatus for performing the operations described herein. This apparatus may be specially constructed for the required purpose, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), RAMs, EPROMs, EEPROMs, magnetic or optical cards, or any type of media suitable for storing electronic instructions, and each coupled to a computer system bus.

The processes and displays presented herein are not inherently related to any particular computer or other apparatus. Various general-purpose systems may be used with programs in accordance with the teachings herein, or it may prove convenient to construct a more specialized apparatus to perform the operations described. The required structure for a variety of these systems will be evident from the description above. In addition, the present invention is not described with reference to any particular programming language. It will be appreciated that a variety of programming languages may be used to implement the teachings of the invention as described herein.

The foregoing discussion merely describes some exemplary embodiments of the present invention. One skilled in the art will readily recognize from such discussion, the accompanying drawings and the claims that various modifications can be made without departing from the spirit and scope of the invention.

What is claimed is:

1. An electronic surveillance method comprising:

activating an electronic tag with an identifier via an access to an open storage area of a memory of the electronic tag, wherein the electronic tag is considered active if the identifier is stored in the open storage area, the identifier identifying an inventory including one or more articles, wherein the electronic tag is attached to one of the articles, and wherein the access to the storage area of the memory of the electronic tag is prohibited from password protection;

configuring an electronic gate device to allow retrieval of the identifier within the electronic gate device without performing database query operations;

inspecting, when the electronic tag is located within a proximity of the electronic gate device, the electronic tag wirelessly from the electronic gate device without performing database query nor password authentication operations via the access to the open storage area of the electronic tag and the retrieval of the identifier within the electronic gate device; and causing an alarm via the electronic gate device if the inspecting indicates the electronic tag is active.

2. The method of claim 1, wherein the electronic tag is configured with a plurality of commands for performing access operations on the memory, the commands including a lock command capable of specifying a portion of the memory to restrict the access operations for the portion of the memory with password protection, and wherein the lock command is ignored if the portion of the memory includes the storage area.

3. The method of claim 2, wherein the activation is based on an electronic reader device wirelessly coupled to the electronic tag.

4. The method of claim 1, wherein each of the articles is attached with a separate active electronic tag storing the identifier.

5. The method of claim 1, wherein the inspecting comprises:

sending one or more requests from the electronic gate device for data stored in the electronic tag, the data freely available without protection via the electronic tag; and receiving the data from the electronic tag in response to the requests, wherein the data indicates whether the identifier is stored in the storage area of the electronic tag.

6. The method of claim 5, wherein the electronic tag stores a separate identifier in a separate storage area outside of the storage area, the separate identifier identifying the article attached with the electronic tag, and wherein the data includes the separate identifier to enable tracking the article at the electronic gate device.

7. The method of claim 1, wherein the identifier is stored at a storage address in the electronic gate device and wherein the retrieval is based on access to the storage address without database query operations.

8. The method of claim 1, further comprising:

deactivating the electronic tag from a point of sale device via the access of the storage area without password protection, wherein the electronic tag is deactivated by storing a data different from the identifier in the storage area to allow the article to pass through the proximity of the electronic gate device without the alarm.

9. The method of claim 1, wherein the electronic tag is activated wirelessly via a dipole antenna of the electronic tag.

10. The method of claim 1, wherein the electronic tag is activated wirelessly via a loop antenna of the electronic tag.

11. An electronic surveillance system comprising:

one or more electronic tags separately attached to articles in an inventory, each electronic tag providing access to a storage area of the electronic tag without protection, wherein the electronic tag is active if the storage area stores an identifier identifying the inventory;

at least one electronic reader device capable of wirelessly activating the electronic tag without authentication, the electronic tag activated to become active; and at least one electronic gate device stationed at a location to guard the inventory, wherein the electronic gate device is configured with the identifier to detect if the electronic tag is active when the electronic tag is within a proximity of the location, and provide an alarm notification if the electronic tag within the proximity of the location is active.

12. The system of claim 11, wherein the detection comprises:

retrieving data from the storage area of the electronic tag wirelessly without an authentication data from the electronic gate device via the access to the storage area of the electronic tag.

13. The system of claim 12, the further comprising:

retrieving the identifier in the electronic gate device without performing database operations; and comparing the identifier retrieved with the data from the storage area of the electronic tag, wherein the electronic tag is active if the comparison indicates the data includes a copy of the identifier retrieved.

14. The system of claim 11, wherein the electronic tag comprises a memory including the storage area, wherein the electronic tag is configured with a plurality of commands for performing access operations on the memory, the commands including a lock command capable of specifying a portion of the memory to restrict the access operations for the portion of the memory with password protection, and wherein the lock command is ignored if the portion of the memory includes the open storage area.

15. The system of claim 14, wherein the access operations include the access to the storage area for reading and writing data without password protection.

16. The system of claim 11, wherein the retrieving comprises:

sending one or more requests from the electronic gate device for data stored in the electronic tag, the data freely available without protection via the electronic tag; and receiving the data from the electronic tag in response to the requests, wherein the data indicates whether the identifier is stored in the storage area of the electronic tag.

17. The system of claim 16, wherein the electronic tag stores a separate identifier in a separate storage area outside of the storage area, the separate identifier identifying the article attached with the electronic tag, and wherein the data includes the separate identifier to enable tracking the article at the electronic gate device.

18. The system of claim 11, wherein the identifier is stored at a storage address in the electronic gate device and wherein the retrieval is based on access to the storage address without database query operations.

19. The system of claim 11, further comprising:

at least one point of sale device stationed to allow removal of the articles from the inventory, the point of sale device being configured to:

deactivate the electronic tag via the access of the storage area without password protection, wherein the electronic tag is deactivated to store a data different from the identifier in the storage area to allow the article to pass through the proximity of the electronic gate device without the alarm notification.

20. The system of claim 11, wherein at least one of the electronic tags comprise a dipole antenna, and wherein the electronic tag is wirelessly activated to become active via the dipole antenna.

21. An electronic surveillance method comprising:

requesting an RFID (radio frequency identifier) tag to store an identifier from an RFID reader device without authentication, wherein the identifier is stored in a storage area of the RFID tag via an access to the storage, and wherein the RFID tag is in an active state if the identifier is stored in the storage area;

configuring an electronic gate device to allow access to the identifier within the electronic gate;

retrieving, when the RFID tag is located within a proximity of the electronic gate device, data stored in the RFID tag wirelessly to the electronic gate device via the access to the storage area of the RFID tag;

determining if the data retrieved from the RFID tag include the identifier, wherein the RFID tag is in an inactive state if the data retrieved does not include the identifier; and causing an alarm via the electronic gate device if the data retrieved from the RFID tag include the identifier.

22. The method of claim 21, further comprising:

updating the RFID tag without authentication from a point of sale device via the access to the storage area of the RFID tag, wherein the RFID tag is updated to be in the inactive state.

23. The method of claim 22, wherein the updating writes a separate identifier to the storage area of the RFID tag, wherein the separate identifier is not equal to the identifier.

24. The method of claim 21, wherein the data is retrieved from the RFID tag wirelessly via a dipole antenna of the RFID tag.

25. An electronic surveillance method comprising:

storing a first multi-bit number into re-writable memory of one or more RFID (Radio Frequency Identifier) tags;

storing a second number different from the first multi-bit number into said re-writable memory at a point of sale;

sending the first multi-bit number to one of the RFID tags at an EAS (Electronic Article Surveillance) gate to compare to a number stored in the re-writable memory of the one RFID tag; and obtaining identifying information from the one RFID tag at the EAS gate, the identifying information indicating the number has not been changed from the first multi-bit number at the one RFID tag based on the comparison.

26. The method of claim 25, wherein an anti-theft alert is activated by the identifying information.

27. The method of claim 25, wherein the identifying information including an identifier identifying the one RFID tag.

28. The method of claim 25, wherein the RFID tags comprise SL (selected) flags, wherein the RFID tags are identified by EPC IDs, and wherein the storing the first multi-bit number comprises:

sending an EPC (Electronic Product Code) Gen (Generation) 2 select command to the RFID tags from a reader device; and transferring the EPC IDs from the RFID tags to the reader for processing the participation of the inventory.

29. The method of claim 28, wherein the select command specifies an action to unset the SL flags of the RFID tags to participate in an inventory.

30. An RFID (Radio Frequency Identifier) reader device for electronic surveillance, comprising:

a memory storing executable instructions, an inventory number and a storage address, the inventory number identifying an inventory and the storage address to access scratch pad memory of RFID tags attached to articles in the inventory;

a wireless network interface coupled to one or more of the RFID tags;

a processor coupled to the memory and the wireless network interface to execute the instructions from the memory, the processor being configured to send a command via the wireless network interface to the one or more of the RFID tags, the command specifying the inventory number and the storage address, collect identifiers from the one or more of the RFID tags, the identifiers identifying which of the one or more of the RFID tags store a number matching the inventory number at the storage address of the scratch pad memory, and send an alarm message to activate an alarm if the identifiers are collected.

31. The RFID reader device of claim 30, wherein the processor is further configured to receive data from the one or more RFID tags, and wherein the processor is further configured to compare the data from the one or more RFID tags with the inventory number stored in the memory.

32. The RFID reader device of claim 30, wherein the identifiers comprise at least one of a status or identity data.

33. A method at a RFID (Radio Frequency Identifier) reader device for electronic surveillance, comprising:

sending a command via a wireless network interface to one or more RFID tags, the command specifying an inventory number and a storage address, the inventory number identifying an inventory and the storage address to access a scratch pad memory of the RFID tags attached to articles in the inventory;

collecting identifiers from the one or more of the RFID tags, the identifiers identifying which of the one or more of the RFID tags store a number matching the inventory number at the storage address of the scratch pad memory, and sending an alarm message to activate an alarm if the identifiers are collected.

34. The method of claim 33, further comprising receiving data from the one or more RFID tags, and comparing the data from the one or more RFID tags with the inventory number stored in the memory.

35. The method of claim 33, wherein the identifiers comprise at least one of a status or identity data.

36. A non-transitory machine readable-storage medium storing instructions that cause a data processing system to perform operations comprising:

sending a command via a wireless network interface to one or more RFID tags, the command specifying an inventory number and a storage address, the inventory number identifying an inventory and the storage address to access a scratch pad memory of RFID tags attached to articles in the inventory;

collecting identifiers from the one or more of the RFID tags, the identifiers identifying which of the one or more of the RFID tags store a number matching the inventory number at the storage address of the scratch pad memory, and sending an alarm message to activate an alarm if the identifiers are collected.

37. The non-transitory machine readable-storage medium of claim 36, further comprising instructions that cause the data processing system to perform operations comprising receiving data from the one or more RFID tags, and comparing the data from the one or more RFID tags with the inventory number stored in the memory.

38. The non-transitory machine readable-storage medium of claim 36, wherein the identifiers comprise at least one of a status or identity data.

39. An electronic tag, comprising:

a memory comprising a first portion prohibited from being locked via at least one of a password or an authentication mechanism to store data indicating if the electronic tag is active or inactive, wherein the electronic tag is considered active if a first identifier is stored in the first portion, the first identifier identifying an inventory comprising a plurality of articles, wherein the electronic tag is associated with one of the articles, and wherein the electronic tag is considered inactive if the first identifier is not stored in the first portion;

a processor coupled to the memory, wherein the processor is configured to receive a command, the command specifying the first identifier; and wherein the processor is configured to send data indicating if the electronic tag is active or inactive in response to the command.

40. The electronic tag of claim 39, wherein the memory comprises a second portion, and wherein the processor is further configured to restrict access to the second portion of the memory, and wherein the second portion of the memory is configured to store a second identifier identifying the article attached with the electronic tag.

41. The electronic tag of claim 39, wherein the first identifier is stored at a storage address in the electronic gate device and wherein the command specifies the storage address to access the first portion of the memory without database query operations.

42. The electronic tag of claim 39, wherein the data other than the first identifier are stored in the first portion to prevent an alarm from occurring when the article attached to the tag is passed at an electronic gate device.

43. The electronic tag of claim 39, wherein the memory stores a lock command, wherein the processor is further configured to restrict access to the second portion of the memory using the lock command, and wherein the processor is configured to ignore the lock command for the first portion of the memory.

44. A method at an electronic tag to provide electronic surveillance comprising:

receiving a command specifying a first identifier, the first identifier identifying an inventory comprising a plurality of articles, wherein the electronic tag is associated with one of the articles, wherein the electronic tag is considered active if a first identifier is stored in a first portion of a memory, and wherein the electronic tag is considered inactive if the first identifier is not stored in the first portion a memory, wherein the first portion is prohibited from being locked via at least one of a password or an authentication mechanism; and sending data indicating if the electronic tag is active or inactive in response to the command.

45. The method of claim 44, wherein the memory comprises a second portion, and wherein the method further comprises restricting access to the second portion of the memory, and wherein the second portion of the memory is configured to store a second identifier identifying the article attached with the electronic tag.

46. The method of claim 44, wherein the first identifier is stored at a storage address in the electronic gate device and wherein the command specifies the storage address to access the first portion of the memory without database query operations.

47. The method of claim 44, wherein the data other than the first identifier are stored in the first portion to prevent an alarm from occurring when the article attached to the tag is passed at an electronic gate device.

48. The method of claim 44, wherein the memory stores a lock command, wherein the method further comprises restricting access to the second portion of the memory using the lock command, and ignoring the lock command for the first portion of the memory.

49. A non-transitory machine readable medium storing instructions that cause a data processing system to perform operations comprising:

receiving a command specifying a first identifier, the first identifier identifying an inventory comprising a plurality of articles, wherein the electronic tag is associated with one of the articles, wherein the electronic tag is considered active if a first identifier is stored in a first portion of a memory, and wherein the electronic tag is considered inactive if the first identifier is not stored in the first portion a memory, wherein the first portion is prohibited from being locked via at least one of a password or an authentication mechanism; and sending data indicating if the electronic tag is active or inactive in response to the command.

50. The non-transitory machine readable medium of claim 49, wherein the memory comprises a second portion, and wherein the non-transitory machine readable medium further comprises instructions that cause the data processing system to perform operations comprising restricting access to the second portion of the memory, and wherein the second portion of the memory is configured to store a second identifier identifying the article attached with the electronic tag.

51. The non-transitory machine readable medium of claim 49, wherein the first identifier is stored at a storage address in the electronic gate device and wherein the command specifies the storage address to access the first portion of the memory without database query operations.

52. The non-transitory machine readable medium of claim 49, wherein the data other than the first identifier are stored in the first portion to prevent an alarm from occurring when the article attached to the tag is passed at an electronic gate device.

53. The non-transitory machine readable medium of claim 49, wherein the memory stores a lock command, and wherein the non-transitory machine readable medium further comprises instructions that cause the data processing system to perform operations comprising restricting access to the second portion of the memory using the lock command, and ignoring the lock command for the first portion of the memory.

54. A method at an electronic gate device to provide an electronic surveillance comprising:

sending a command specifying a first identifier to a tag to compare to data stored in a first portion of a memory of the tag, the first identifier identifying an inventory comprising a plurality of articles, wherein the tag is associated with one of the articles, wherein the tag is considered active if the first identifier is stored in the first portion, and wherein the electronic tag is considered inactive if the data other than the first identifier are stored in the first portion;

receiving data from the tag in response to the command, the data indicating if the tag is active or inactive; and activating an alarm if the data indicates that the tag is active.

55. The method of claim 54, wherein the first identifier is stored at a storage address in the electronic gate device and wherein the first identifier is retrieved from the storage address without database query operations.

56. The method of claim 54, further comprising comparing the first identifier with the data received from the tag; and preventing the alarm from being activated if the data are other than the first identifier.

57. The method of claim 54, further comprising storing the first identifier.

58. A non-transitory machine readable-storage medium storing data that, when accessed by a data processing system, cause the data processing system to perform operations comprising:

sending a command specifying a first identifier to a tag to compare to data stored in a first portion of a memory of the tag, the first identifier identifying an inventory comprising a plurality of articles, wherein the tag is associated with one of the articles, wherein the tag is considered active if the first identifier is stored in the first portion, and wherein the electronic tag is considered inactive if the data other than the first identifier are stored in the first portion;

receiving data from the tag in response to the command, the data indicating if the tag is active or inactive; and activating an alarm if the data indicates that the tag is active.

59. The non-transitory machine readable medium of claim 58, wherein the first identifier is stored at a storage address in the electronic gate device and wherein the first identifier is retrieved from the storage address without database query operations.

60. The non-transitory machine readable medium of claim 58, further comprising instructions that cause the data processing system to perform operations comprising comparing the first identifier with the data received from the tag; and preventing the alarm from being activated if the data are other than the first identifier.

61. The non-transitory machine readable medium of claim 58, further comprising instructions that cause the data processing system to perform operations comprising storing the first identifier.

* * * * *